US006267466B1

(12) United States Patent
Gudaitis et al.

(10) Patent No.: US 6,267,466 B1
(45) Date of Patent: Jul. 31, 2001

(54) OPTICAL ENCODER SYSTEM AND METHOD FOR USE IN PRINTING DEVICES

(75) Inventors: Algird M Gudaitis, Vancouver; Ronald A Juve, Brush Prairie; Rick M Tanaka; Matias Negatu, both of Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/175,159

(22) Filed: Oct. 19, 1998

(51) Int. Cl.[7] ..... B41J 23/00; B41J 29/38; B41J 2/165

(52) U.S. Cl. ..... 347/37; 347/11; 347/12; 347/33; 347/14

(58) Field of Search ..... 347/37, 11, 12, 347/23, 14; 400/2, 3, 4, 9, 283, 219, 279

(56) References Cited

U.S. PATENT DOCUMENTS

| | | | |
|---|---|---|---|
| 4,922,270 | 5/1990 | Cobbs et al. | 346/140 R |
| 5,109,239 | 4/1992 | Cobbs et al. | 346/140 R |
| 5,426,457 | 6/1995 | Raskin | 347/37 |
| 5,519,415 | 5/1996 | Raskin | 347/9 |
| 5,561,449 | 10/1996 | Raskin et al. | 347/37 |
| 5,563,591 * | 10/1996 | Jacobs et al. | 347/37 |
| 5,614,930 | 3/1997 | Osborne et al. | 347/33 |

* cited by examiner

*Primary Examiner*—John Barlow
*Assistant Examiner*—Charles W. Stewart, Jr.
(74) *Attorney, Agent, or Firm*—Erik A. Anderson

(57) ABSTRACT

Optical encoder system designs and methods for use thereof in printing devices are disclosed which are directed to solving problems caused by contaminant matter accumulating on optical encoder strips as well as scratching of optical encoder strips.

An embodiment includes a dispenser and a take-up mechanism. The dispenser includes an encoder strip having first and second lengths. The second length of encoder strip is substantially free of contaminant matter. The first length of the encoder strip is coupled to the take-up mechanism so that the first length of the encoder strip is positioned between the dispenser and take-up mechanism. The take-up mechanism is configured to advance at least a portion of the second length of the encoder strip from the dispenser to a position between the dispenser and take-up mechanism upon actuation of the take-up mechanism.

An embodiment of a method in accordance with the present invention includes providing a first length of encoder strip to the printing device for use during printing that is substantially free of contaminant matter upon initial provision to the printing device. The method additionally includes removing the first length of encoder strip from use by the printing device and advancing a second length of encoder strip to the printing device for use during printing that is substantially free of contaminant matter upon initial advancement to the printing device.

Modifications to these embodiments as well as other embodiments are within the scope and spirit of the present invention.

16 Claims, 7 Drawing Sheets

OPTICAL ENCODER SYSTEM AND METHOD FOR USE IN PRINTING DEVICES

BACKGROUND AND SUMMARY

The present invention relates to optical encoders. More particularly, the present invention relates to optical encoder systems and methods for use in printing devices.

Printing devices, such as inkjet printers, use printing composition (e.g., ink or toner) to print text, graphics, images, etc. onto print media. Inkjet printers may use print cartridges, also known as "pens", which shoot drops of printing composition, referred to generally herein as "ink", onto a print medium such as paper or transparencies. Each pen has a printhead that includes a plurality of nozzles. Each nozzle has an orifice through which the ink drops are fired. To print an image, the printhead is propelled back and forth across the page by, for example, a carriage, while shooting drops of ink in a desired pattern as the printhead moves. The particular ink ejection mechanism within the printhead may take on a variety of different forms known to those skilled in the art, such as thermal printhead technology.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from a orifice associated with the energized resistor. By selectively energizing the resistors as the printhead moves across the page, the ink is expelled in a pattern onto the print media to form a desired image (e.g., picture, chart or text).

Inkjet printers may depend on a linear displacement optical encoder strip to trigger the firing of the pens as well as to provide feedback for position and velocity of the carriage holding the pens. The optical encoder strip may be made from things such as photo imaged MYLAR brand film. The optical encoder strip works with a light source and a light detector, both of which are typically mounted on the carriage in a single package. The light source directs light through the strip which is received by the light detector and converted into an electrical signal which is used by electronics of the printing device to control firing of the pens, as well as carriage position and velocity. Markings or indicia on the encoder strip periodically block this light from the light detector in a predetermined manner which results in a corresponding change in the electrical signal from the detector.

As the pens eject droplets of ink through the printhead orifices, a certain amount of ink is dispersed within the printing device as aerosol. Print media dust can also be produced within the printing device as the printing device handles print media. This aerosol and dust is contaminant matter that is deposited on the interior surfaces of the printing device and also onto the optical encoder strip. The build-up of these contaminants on the optical encoder strip reduces the amount of light from the light source that reaches the light detector. The optical encoder strip can also become scratched. These conditions can lead to a loss of both information and control of carriage position and velocity, as well as timing associated with pen firing. Several problems can arise from these losses, including degradation of print quality and driving of the carriage into a failure state which causes the printing device to cease to operate.

Alleviation of these problems would be a desired improvement, thereby increasing the useful life of a printing device. Accordingly, the present invention is directed to solving printing device problems caused by both contaminant matter accumulating on printing device optical encoder strips and scratches occurring on optical encoder strips. The present invention accomplishes this objective by providing optical encoder systems and methods for use of these systems in printing devices.

An embodiment of the present invention is an optical encoder system for use in a printing device that includes a dispenser and a take-up mechanism. The dispenser includes an encoder strip which has a first length and a second length. The second length of encoder strip is substantially free of contaminant matter. The first length of the encoder strip is coupled to the take-up mechanism so that the first length of the encoder strip is positioned between the dispenser and the take-up mechanism. The take-up mechanism is configured to advance at least a portion of the second length of the encoder strip from the dispenser to a position between the dispenser and the take-up mechanism upon actuation of the take-up mechanism.

The above-described embodiment of the present invention may be modified and include the following characteristics described below. A cleaner may be included which is configured to remove contaminant matter on the encoder strip during advancement of the encoder strip. The cleaner may include a wiper or a scraper in contact with the encoder strip during removal of the contaminant matter therefrom. The cleaner may additionally or alternatively include a liquid applied to the encoder strip by, for examples one or more pads.

The encoder strip may be formed as a loop which is positioned around the dispenser and the take-up mechanism.

A tensioning device may be included which is configured to keep the encoder strip substantially taut between the dispenser and the take-up mechanism.

A container may be included in which a portion of the encoder strip is placed. The container is configured to keep the encoder strip therein substantially free of contaminant matter and also protects the encoder strip from scratching while in the container. A seal may be positioned between the container and a portion of the encoder strip.

The container, take-up mechanism, and dispenser may be formed as a cassette or a cartridge. The optical encoder system may be used in a printing device.

An alternative embodiment of the present invention for use in a printing device includes an encoder strip and structure for selectively supplying a predetermined portion of the length of the encoder strip to the printing device for use by the printing device during printing. In this embodiment, the encoder strip has a length and the supplying structure supplies to the printing device a predetermined portion of the length of the encoder strip that is substantially free of contaminant matter.

The embodiment of the present invention described in the paragraph immediately above may be modified and include the following characteristics described below. Additional structure may be included for cleaning contaminant matter from the encoder strip. Additional structure may also be included for tensioning the encoder strip. The optical encoder system may be used in a printing device.

An embodiment of a method in accordance with the present invention for use in a printing device includes providing a first length of encoder strip to the printing device for use by the printing device during printing. This first length of encoder strip is substantially free of contaminant matter upon initial provision to the printing device. The method additionally includes removing the first length of encoder strip from use by the printing device and advancing at least a portion of a second length of encoder strip to the printing device for use by the printing device during printing. This second length of the encoder strip is substantially free of contaminant matter upon initial advancement to the printing device.

The above-described embodiment of the method of the present invention may be modified and include the following characteristics described below. The method may include cleaning the first length of the encoder strip to remove contaminant matter therefrom. In such cases, the method additionally includes removing the portion of the second length of encoder strip from use by the printing device and, subsequent to cleaning, advancing the first length of encoder strip to the printing device for use by the printing device during printing.

Other objects, advantages, and novel features of the present invention will become apparent from the following detailed description of the invention when considered in conjunction with the accompanying drawings.

DETAILED DESCRIPTION OF THE DRAWINGS

Figure 1:
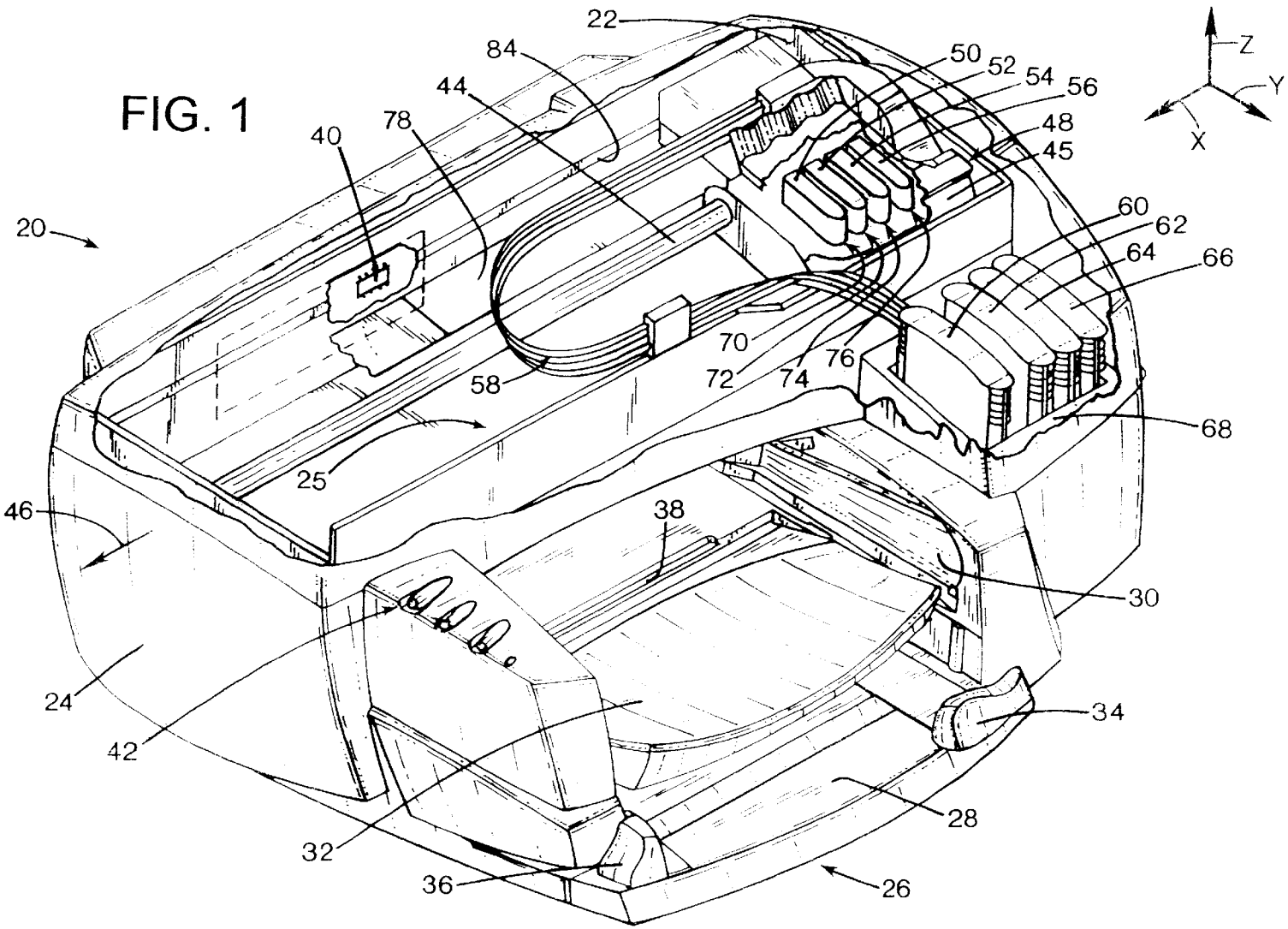
FIG. 1 is a perspective view of a printing device that includes an embodiment of the present invention.

FIG. 1 illustrates an embodiment of an inkjet printing device 20, here shown as an "off-axis" ink-jet printer, constructed in accordance with the present invention, which many be used for printing business reports, correspondence, desktop publishing, and the like, in an industrial, office, home or other environment. A variety of inkjet printing devices are commercially available. For instance, some of the printing devices that may embody the present invention include plotters, portable printing units, copiers, cameras, video printers, and facsimile machines, to name a few, as well as various combination devices, such as a combination facsimile and printer. For convenience, the concepts of the present invention are illustrated in the environment of an inkjet printer 20.

While it is apparent that the printing device components may vary from model to model, the typical inkjet printer 20 includes a frame or chassis 22 surrounded by a housing, casing or enclosure 24, typically made of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. Media handling system 26 has an input supply feed tray 28 for storing sheets of print media before printing. A series of conventional print media drive rollers driven by a stepper motor and drive gear assembly (not shown) may be used to move the print media from the feed tray 28, through the printzone 25, and, after printing, onto a pair of extended output drying wing members 30, shown in a retracted or rest position in FIG. 1. Wings 30 momentarily hold a newly printed sheet of print media above any previously printed sheets still drying in an output tray portion 32, then wings 30 retract to the sides to drop the newly printed sheet into the output tray 32. Media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

Printing device 20 also has a printer controller, illustrated schematically as a microprocessor 40, that receives instructions from a host device, typically a computer, such as a personal computer (not shown). Many of the printer controller functions may be performed by the host computer, by electronics on board the printer, or by interactions between the host computer and the electronics. As used herein, the term "printer controller 40" encompasses these functions, whether performed by the host computer, the printer, an intermediary device between the host computer and printer, or by combined interaction of such elements. Printer controller 40 may also operate in response to user inputs provided through a key pad 42 located on the exterior of the casing 24. A monitor (not shown) coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by chassis 22 to slidably support an off-axis inkjet pen carriage system 45 for travel back and forth across printzone 25 along a scanning axis 46. As can be seen in FIG. 1, scanning axis 46 is substantially parallel to the X-axis of the XYZ coordinate system shown in FIG. 1. Carriage 45 is also propelled along guide rod 44 into a servicing region, as indicated generally by arrow 48, located within the interior of housing 24. A conventional carriage drive gear and dc (direct current) motor assembly (both of which are not shown in FIG. 1) may be coupled to drive an endless loop 49 (see FIG. 2), which may be secured in a conventional marner to carriage 45, with the dc motor operating in response to control signals received from the controller 40 to incrementally advance carriage 45 along guide rod 44 in response to rotation of the dc motor.

Figure 2:
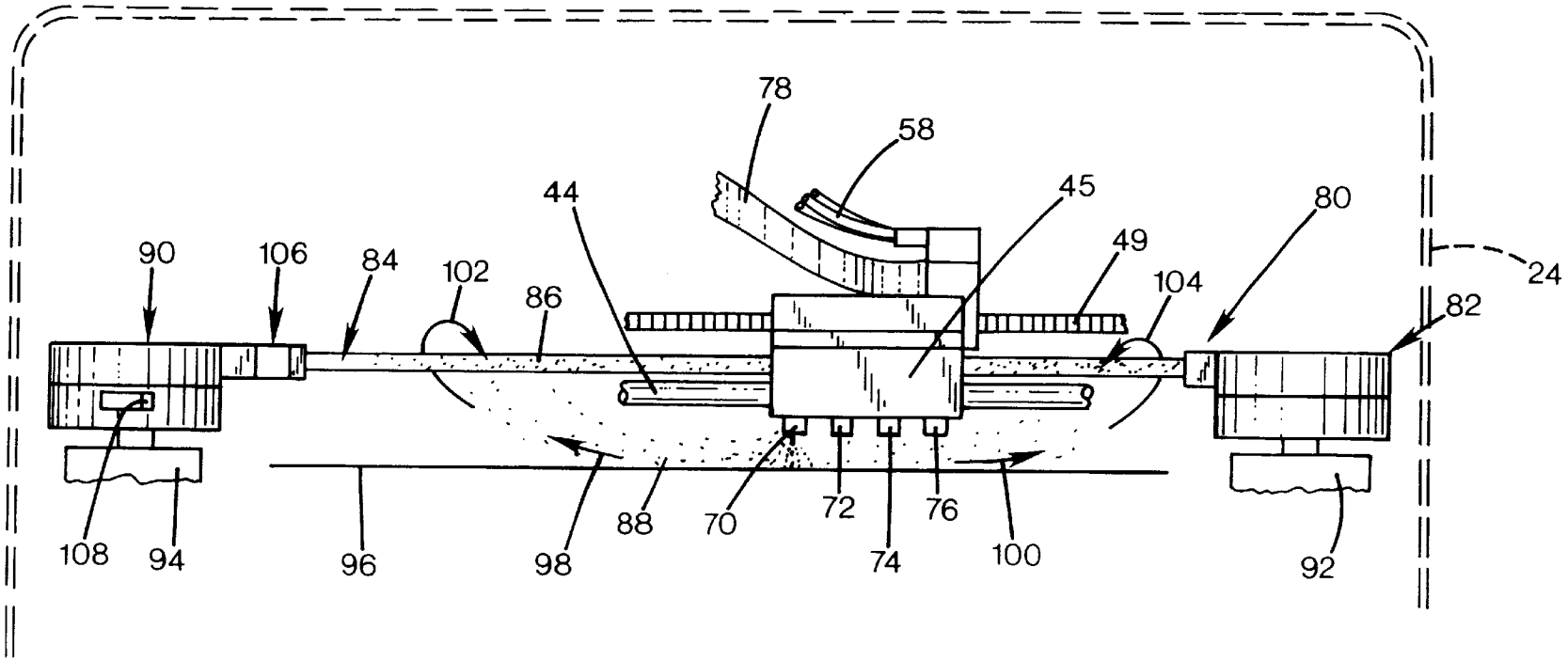
FIG. 2 is a side view of an embodiment of an optical encoder system constructed in accordance with the present invention.

In printzone 25, the media sheet receives ink from an inkjet cartridge, such as a black ink cartridge 50 and three monochrome color ink cartridges 52, 54 and 56, shown schematically in FIG. 2. Cartridges 50, 52, 54, and 56 are also often called "pens" by those in the art. Pens 50, 52, 54, and 56 each include small reservoirs for storing a supply of ink in what is known as an "off-axis" ink delivery system, which is in contrast to a replaceable ink cartridge system where each pen has a reservoir that carries the entire ink supply as the printhead reciprocates over printzone 25 along the scan axis 46. The replaceable ink cartridge system may be considered as an "on-axis" system, whereas systems which store the main ink supply at a stationary location remote from the printzone scanning axis are called "off-axis" systems. It should be noted that the present invention is operable in both off-axis and on-axis systems.

In the illustrated off-axis printer 20, ink of each color for each printhead is delivered via a conduit or tubing system 58 from a group of main stationary ink reservoirs 60, 62, 64, and 66 to the on-board reservoirs of respective pens 50, 52, 54, and 56. Stationary ink reservoirs 60, 62, 64, and 66 are replaceable ink supplies stored in a receptacle 68 supported by printer chassis 22. Each of pens 50, 52, 54, and 56 has a respective printhead 70, 72, 74, and 76 which selectively ejects ink to from an image on a sheet of media in printzone 25.

Printheads 70, 72, 74, and 76 each have an orifice plate with a plurality of nozzles formed therethrough in a manner well known to those skilled in the art. The illustrated printheads 70, 72, 74, and 76 are thermal inkjet printheads, although other types of printheads may be used, such as piezoelectric printbeads. Thermal printheads 70, 72, 74, and 76 typically include a plurality of resistors which are associated with the nozzles. Upon energizing a selected resistor, a bubble of gas is formed which ejects a droplet of ink from the nozzle onto a sheet of print media in printzone 25 under the nozzle. The printhead resistors are selectively energized in response to firing command control signals delivered by a multi-conductor strip 78 from the controller 40 to printhead carriage 45.

To provide carriage positional feedback information to printer controller 40, a conventional optical encoder strip 84 (see FIG. 2) may extend along the length of the printzone 25 and over the service station area 48, with a conventional optical encoder reader 85 (see FIG. 3) being mounted on a back surface of printhead carriage 45 to read positional information provided by encoder strip 84. Printer 20 uses optical encoder strip 84 and optical encoder reader 85 to trigger the firing of printheads 70, 72, 74, and 76, as well as to provide feedback for position and velocity of carriage 45. Optical encoder strip 84 may be made from things such as photo imaged MYLAR brand film, and works with a light source and a light detector (both of which are not shown) of optical encoder reader 85. The light source directs light through strip 84 which is received by the light detector and converted into an electrical signal which is used by controller 40 of printing device 20 to control firing of printheads 70, 72, 74, and 76, as well as carriage 45 position and velocity. Markings or indicia on encoder strip 84 periodically block this light from the light detector in a predetermined manner which results in a corresponding change in the electrical signal from the detector. The manner of providing positional feedback information via optical encoder reader 85 may be accomplished in a variety of different ways known to those skilled in the art.

A side view of an embodiment of an optical encoder system 80 constructed in accordance with the present invention is shown in FIG. 2. As shown in FIG. 2, optical encoder system 80 includes a dispenser 82 that includes a supply of optical encoder strip 84. The supply of optical encoder strip 84 includes a first length 86 outside of dispenser 82 that is exposed to scratching and contaminant matter 88, such as aerosol and paper dust, and at least a second length (not shown in FIG. 2) inside of dispenser 82 that is substantially free of contaminant matter and protected from scratching. These first and second lengths may or may not have the same dimensions. Dispenser 82 helps shield the portion of optical encoder strip 84 therein from such contaminant matter and scratching. It should be noted that the use of the word substantially in this document is used to account for things such as engineering and manufacturing tolerances, as well as other variations that do not affect performance of the present invention.

Optical encoder system 80 also includes a take-up mechanism 90 to which first length 86 of optical encoder strip 86 is coupled so that strip 86 is positioned between dispenser 82 and take-up mechanism 90. As can be seen in FIG. 2, dispenser 82 is attached to a mount 92 which in turn is attached to chassis 22 of printer 20. As can also be seen in FIG. 2, take-up mechanism 90 is attached to mount 94 which in turn is also attached to chassis 22 of printer 20. In this manner, optical encoder system 80 is placed in housing 24 of printer 20. The exteriors of dispenser 82 and take-up mechanism 90 may be made from plastic or other durable material.

A sheet of print media 96 is shown in FIG. 2 on which text and/or graphics are being printed via printheads 70, 72, 74, and 76, as discussed above. Undesirable by-products of this printing include ink aerosol from printheads 70, 72, 74, and 76, as well as paper dust from print media 96, both of which are illustrated as contaminant matter 88 in FIG. 2. Contaminant matter 88 tends to migrate throughout printer 20, as shown by arrows 98 and 100. Some of this contaminant matter inevitably lands on optical encoder strip 84, as shown by arrows 102 and 104. Contaminant matter 88 collects over time on encoder strip 84 so that optical encoder reader 85 cannot accurately read the markings or indicia on encoder strip 84. When this occurs, controller 40 of printer 20 cannot accurately control the velocity and position carriage 45, or the timing of the firing of printheads 70, 72, 74, and 76. This condition degrades print quality and, in more serious cases, renders printer 20 inoperable. Scratches on optical encoder strip 84, depending on the severity, can also cause these problems.

The present invention is directed to alleviating these problems caused by scratching and contaminant matter accumulating on printing device optical encoder strips. The present invention accomplishes this by providing optical encoder systems and methods for use of these systems in printing devices, such as optical encoder system 80 and other systems and methods described below.

Take-up mechanism 90 of optical encoder system 80 is configured to advance at least a portion of the second length of optical encoder strip 84 from dispenser 82 to a position between dispenser 82 and take-up mechanism 90 upon actuation of take-up mechanism 90. Such actuation of take-up mechanism 90 may occur in a variety of ways, some of which are described in detail below. One such way is by use of a ratchet assembly in take-up mechanism 90, carriage tab 108 of which is shown in FIG. 2. Carriage 45 of printer 20 may be periodically moved by controller 40 to engage tab 108 to advance at least a portion of the second length of encoder strip 84, as more fully discussed below.

Figure 3:
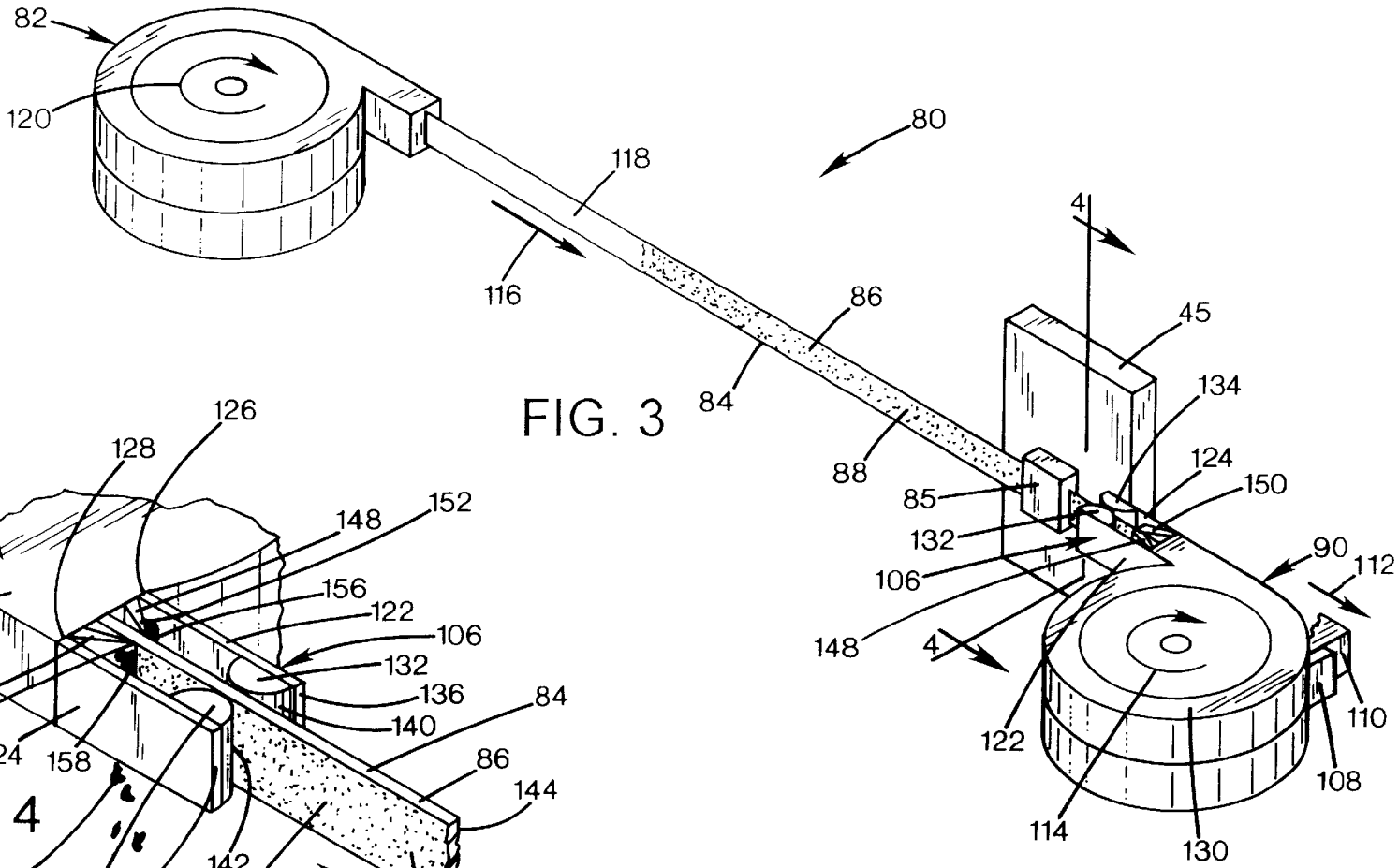
FIG. 3 is a perspective view of the embodiment of the optical encoder system shown in FIG. 2.

A perspective view of optical encoder system 80 is shown in FIG. 3. As can be seen in FIG. 3, optical encoder system 80 further includes a cleaner 106 which is configured to remove contaminant matter 88 from optical encoder strip 84 as strip 84 is advanced by take-up mechanism 90. As discussed above, take-up mechanism 90 uses a ratchet assembly to advance optical encoder strip 84. Carriage 45 includes an extension 110 that is designed to engage tab 108 of this ratchet assemble during movement of carriage 45 toward take-up mechanism 90. As shown in FIG. 3, this engagement between extension 110 and tab 108 moves tab 108 in a direction shown by arrow 112. Movement of tab 108 in this direction causes the ratchet assembly of take-up mechanism 90 to turn in a clockwise direction generally shown by arrow 114 in FIG. 3. This rotation advances optical encoder strip 84 a predetermined amount in a direction shown by arrow 116 in FIG. 3 such that at least a portion of the first length of encoder strip 86 is moved past cleaner 106 and into take-up mechanism 90, and at least a portion of the second length 118 of encoder strip is removed from dispenser 82, as shown by arrow 120 in FIG. 3, to a position between dispenser 82 and take-up mechanism 90 for use with optical encoder reader 85. As can be seen in FIG. 3, contaminant matter 88 is covering first length 86 of encoder strip 84 while the portion of the second length 118 of encoder strip 84 is substantially free of contaminant matter. As first length of encoder strip 86 is moved past cleaner 106, contaminant matter 88 is removed before strip 86 is stored in take-up mechanism 90 on, for example, a wheel or spool, as more fully discussed below.

After this advancement, controller 40 moves carriage 45 away from take-up mechanism 90 to disengage extension 110 from tab 108 of the ratchet assembly so that tab 108 returns to the position shown in FIG. 2. Further advancement of encoder strip 84 may be brought about by controller 40 again advancing carriage 45 toward take-up mechanism 90 so that extension 110 again engages and deflects tab 108 in the direction shown by arrow 112, as described above.

Figure 4:
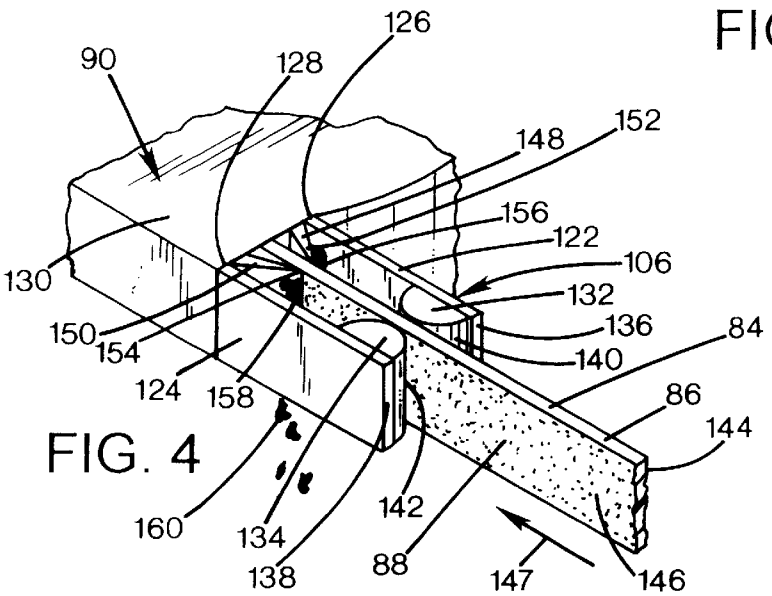
FIG. 4 is an enlarged perspective view of an embodiment of a cleaner constructed in accordance with the present invention taken along line 4—4 of FIG. 3.
Figure 5A:
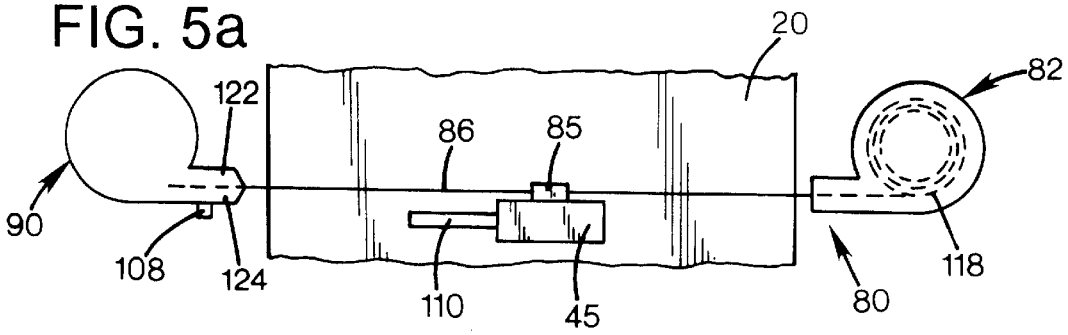
FIGS. 5*a*–5*d* illustrate top diagrammatic views of a method in accordance with the present invention of operating the optical encoder system shown in FIGS. 2–4.
Figure 5B:
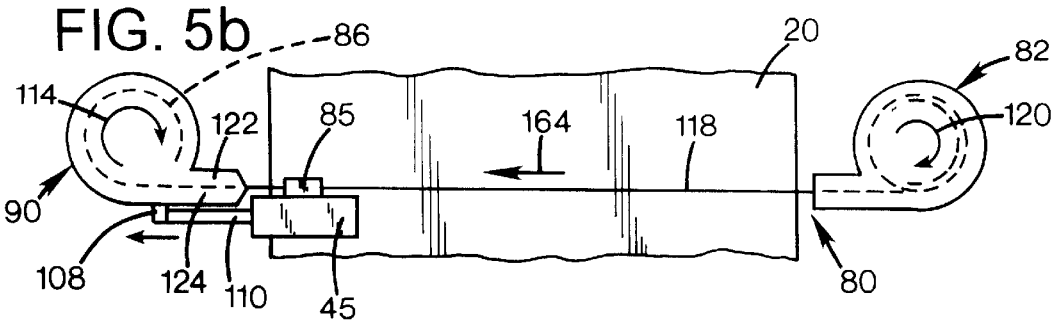

An enlarged perspective view of cleaner 106 taken along line 4—4 of FIG. 3 is shown in FIG. 4. As can be seen in FIG. 4, cleaner 106 includes a pair of cantilevered arms 122 and 124 each of which is connected at one respective end 126 and 128 to casing or body 130 of take-up mechanism 90. Cleaner 106 also includes pads 132 and 134 which are attached to or formed on respective distal ends 136 and 138 of arms 122 and 124. Pads 132 and 134 may be made from foam. As can be seen in FIG. 4, pads 132 and 134 include respective rounded peripheries 140 and 142 that contact sides 144 and 146 of optical encoder strip 84 in a smooth manner. Pads 132 and 134 contain a liquid, such as a cleaning solution (e.g., polyethylene glycol (PEG), ink vehicle, etc.), that is applied to sides 144 and 146 of optical encoder strip 84 to aid in removal of contaminant matter 88 therefrom as optical encoder strip 84 is advanced by take-up mechanism 90 in a direction shown by arrow 147. As can seen in FIG. 4, cleaner 106 further includes a pair of wipers or scrapers 148 and 150 which are attached to or formed on proximal ends 126 and 128 of respective arms 122 and 124, or, alternatively, attached or formed on casing or body 130 of take-up mechanism 90 adjacent to proximal ends 126 and 128 or respective arms 122 and 124. Wipers or scrapers 148 and 150 may be made from plastic, elastomer, or other similar material. Wipers or scrapers 148 and 150 include respective ends 152 and 154 that are formed to engage respective sides 144 and 146 of optical encoder strip 84 to remove contaminant matter 88 therefrom when optical encoder strip 84 is advanced in the direction of arrow 147, as shown by removed contaminate matter masses 156, 158, and 160 in FIG. 4. First length 86 of optical encoder strip 84 is then stored in take-up mechanism 90 with sides 144 and 146 thereof being substantially free of contaminant manner. In this state, first length 86 of optical encoder strip 84 may be used again by optical encoder reader 85 of printing device 20, as described more fully below, A method in accordance with the present invention of operating optical encoder system 80 is shown in FIGS. 5*a*–5*d*. FIG. 5*a* illustrates optical encoder system 80 in printing device 20 with first length 86 of optical encoder strip 84 being provided for use by optical encoder reader 85. This first length 86 is initially substantially free of contaminant matter 88 and scratches. As discussed above, after a period of printing, contaminant matter 88 from things such as ink aerosol and paper dust builds-up on first portion 86 of optical encoder strip 84 obscuring it from optical encoder reader 85 which can lead to degradation of print quality and inoperability of printing device 20. Scratching of first portion 86 of optical encoder strip 84 may also occur. Controller 40 of printing device 20 may monitor for this scratching and/or build-up of contaminant matter 88. When detected, controller 40 removes the first length 86 of encoder strip 84 from use by optical encoder reader 85 and simultaneously advances at least a portion of the second length 118 of encoder strip 84 for use by optical encoder reader 85, as illustrated in FIG. 5*b* and discussed above. First length 86 of optical encoder strip 84 is removed and at least a portion of second length 118 of optical encoder strip 84 advanced by engagement between carriage extension 110 and tab 108 of the ratchet assembly of take-up mechanism 90, as shown by arrow 164 in FIG. 5*b* and discussed above. Second length 118 of optical encoder strip 84 is substantially free of contaminant matter and, upon initial use, substantially free of scratches. Contaminant matter 88 is removed from first length 86 of optical encoder strip 84 before being stored in take-up mechanism 90, as discussed above. In one embodiment of the method of the present invention illustrated in FIGS. 5*a*–5*d*, the action illustrated in FIG. 5*b* may be manually initiated by a user of printing device 20 as well in response to monitoring of scratches and contaminant matter 88 build-up by controller 40.

Figure 5C:
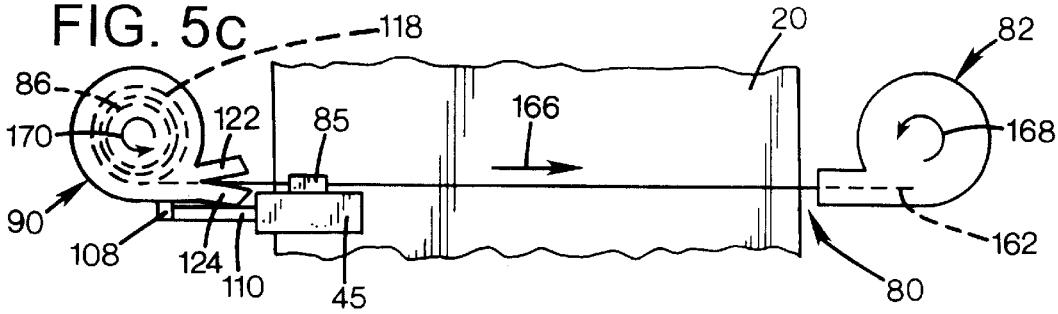

After all of the useful portions of the second length 118 of optical encoder strip 84 have been used, cleaned and stored in take-up mechanism 90, the method of the present invention provides for rewinding of optical encoder strip 84 into dispenser 82, as shown by arrow 166 and illustrated in FIG. 5*c*. This action may be initiated by controller 40 and, in one embodiment of the method of the present invention illustrated in FIGS. 5*a*–5*d*, the action illustrated in FIG. 5*c* may also be manually initiated by a user of printing device 20 as well. As can be seen in FIG. 5*c*, carriage extension 110 engages tab 108 of the ratchet assembly of take-up mechanism 90 during this rewinding to a position allowing this movement, and arms 122 and 124 move to the position shown. Dispenser 82 is caused to move in a counter-clockwise direction as shown by arrow 168 to retrieve optical encoder strip 84 which causes take-up mechanism 90 to also rotate in a counter-clockwise direction as shown by arrow 170. Dispenser 82 may be moved in this counter-clockwise direction by a motor, a ratchet assembly, manual actuation, or otherwise.

Figure 5D:
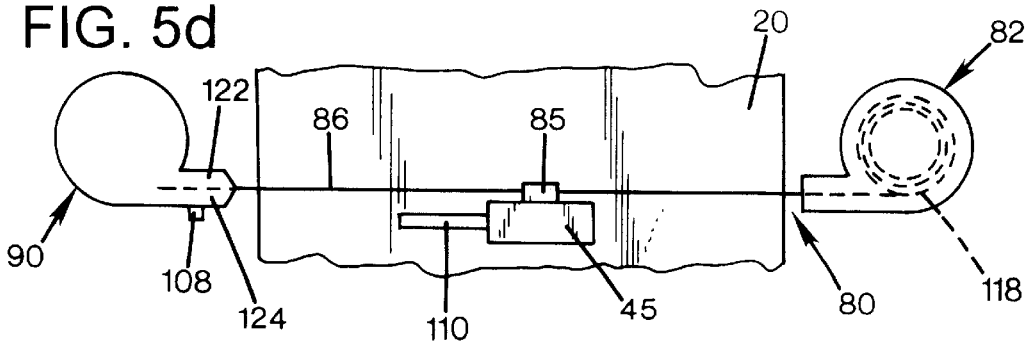

FIG. 5*d* illustrates first length 86 of optical encoder strip 84 again substantially free of contaminant matter 88 and again in use by optical encoder reader 85. The sequence of steps illustrated in FIGS. 5*a*–5*d* may be repeated a number of times as needed.

Figure 6:
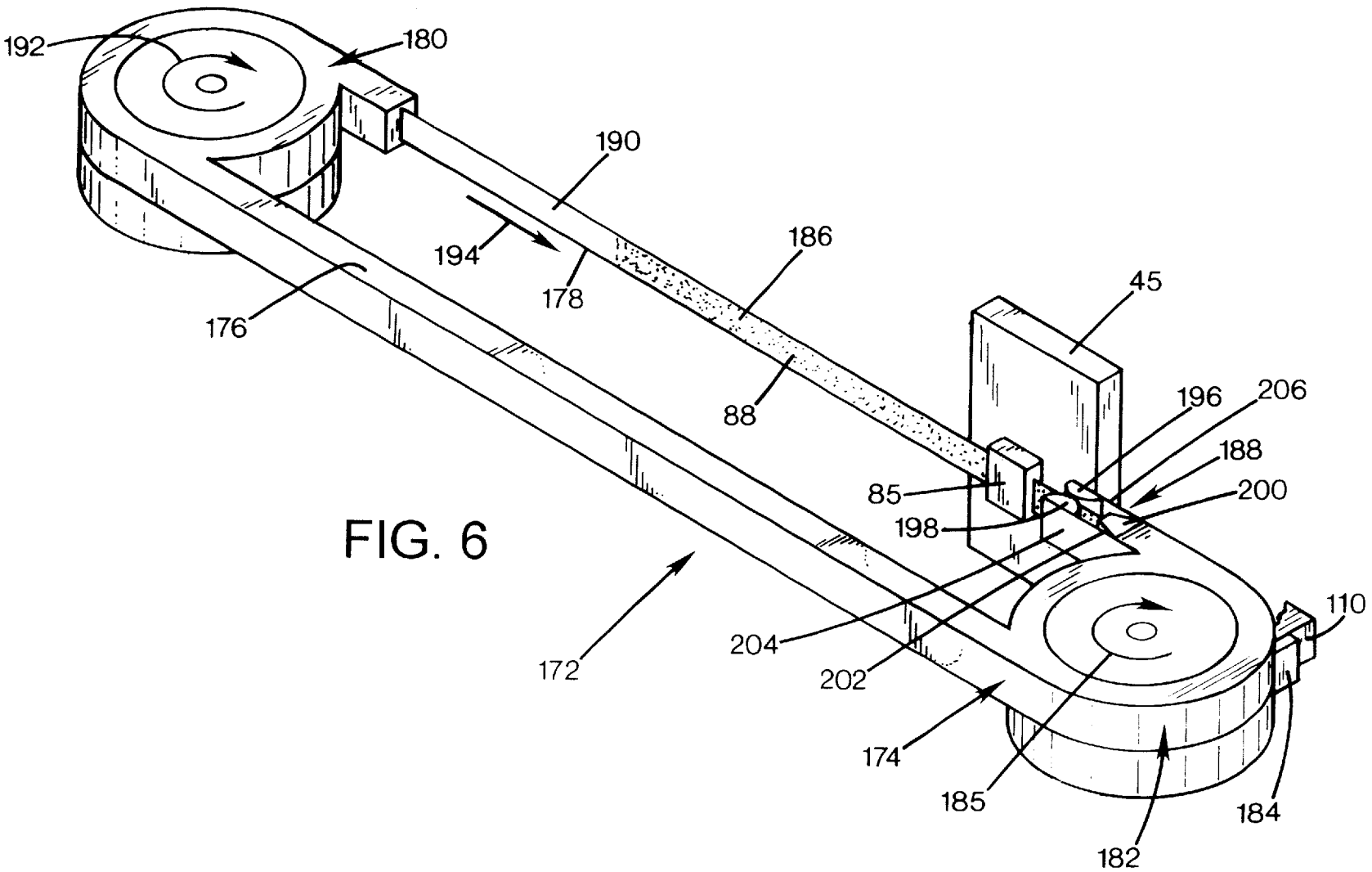
FIG. 6 is a perspective view of an alternative embodiment of an optical encoder system constructed in accordance with the present invention.

A perspective view of an alternative embodiment of an optical encoder system 172 constructed in accordance with the present invention is shown in FIG. 6. Optical encoder system 172 is illustrated in use by optical encoder reader 85, as described above in connection with optical encoder system 80.

As can be seen in FIG. 6, optical encoder system 172 is constructed in a single unit as a cartridge or cassette 174. Cartridge 174 includes a container 176 and an optical encoder strip 178 which is formed as a loop. A portion of encoder strip 178 is placed in container 176. Container 176 is configured to keep the portion of encoder strip 178 therein substantially free of contaminant matter 88 and also protects the portion of encoder strip 178 inside of container 176 from scratching.

Cartridge 176 also includes a dispenser 180 and a take-up mechanism 182. Take-up mechanism 182 includes ratchet assembly and tab 184, like that of take-up mechanism 90 and tab 108 discussed above, that is engaged by carriage extension 110 so that take-up mechanism 182 rotates in a clockwise direction indicated by arrow 185 to advance first length 186 of optical encoder strip 178 toward cleaner 188, and so that dispenser 180 also rotates in a clockwise direction indicated by arrow 192 to advance a second length 190 of optical encoder strip 178 out of dispenser 180 in a direction shown by arrow 194. The first and second lengths may or may not have the same dimensions. As can be seen in FIG. 6, this second length 190 of optical encoder strip 178 is substantially free of contaminant matter. The exterior of cartridge or cassette 174, including container 176, dispenser 180, and take-up mechanism 182, may be made from plastic or other durable material.

Cleaner 188 is designed like cleaner 106 of optical encoder system 80 and includes a pair of pads 196 and 198, as well as a pair of wipers or scrapers 200 and 202. Pads 196 and 198 may be made from a foam. Wipers or scrapers 200 and 202 may be made from plastic, elastomer, or other similar material. Cleaner 188 is designed to remove contaminant matter 88 from optical encoder strip 178 as it is advanced in the direction shown by arrow 194. Cleaner 188 differs from cleaner 106 in that arms 204 and 206 do not need to pivot as do arms 122 and 124 of cleaner 106, as illustrated in FIG. 5*c*.

Figure 7:
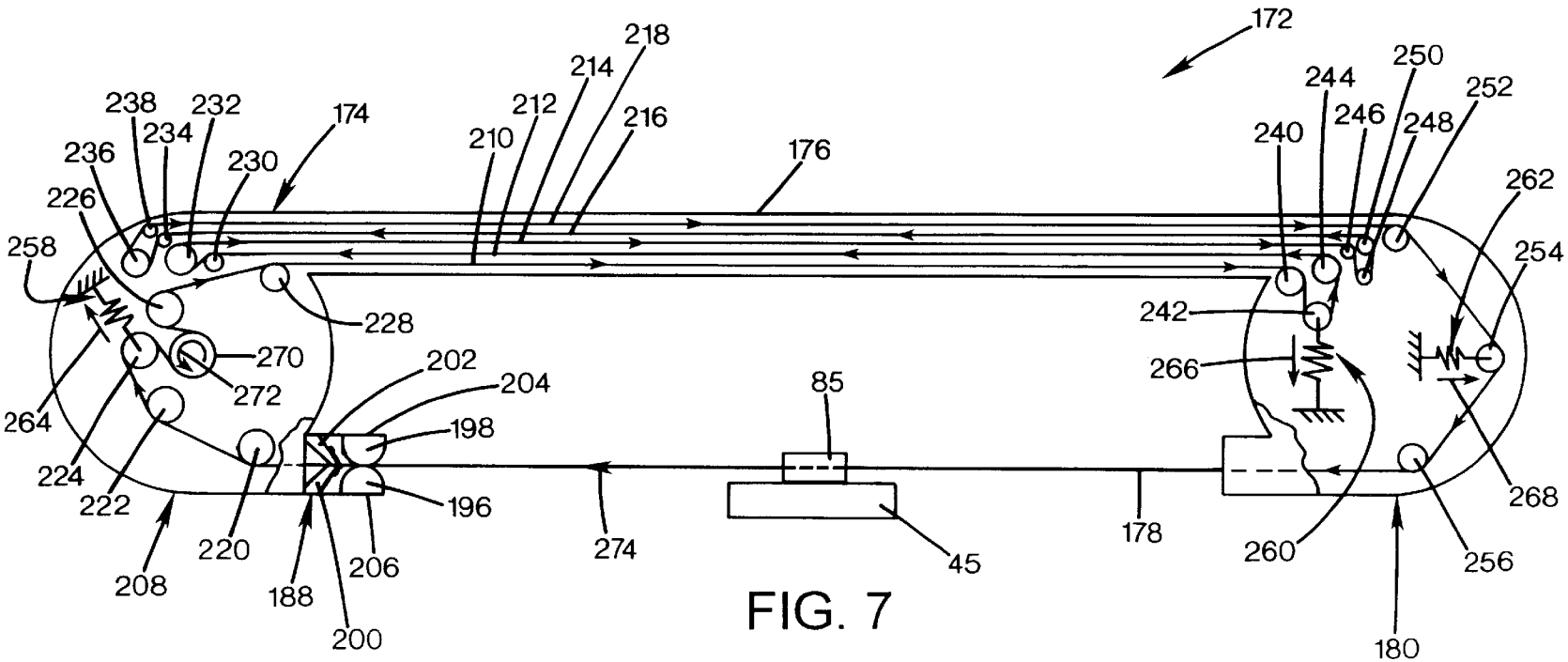
FIG. 7 is a top, internal view of the optical encoder system shown in FIG. 6 with a different take-up mechanism than the take-up mechanism shown in FIG. 6.

A top, internal view of optical encoder system 172 with a different take-up mechanism 208 is shown in FIG. 7. It should be noted that either take-up mechanism 182 or take-up mechanism 208 will work with optical encoder system 172. As discussed above and as shown in FIG. 7, optical encoder strip 178 is formed as a loop of a predetermined length that is folded a number of times into a plurality of sections 210, 212, 214, 216, and 218 to reduce the overall size of cassette 174. Sections 210, 212, 214, 216, and 218 of strip 178 extend over a plurality of idlers 220, 222, 224, 226, 228, 230, 232, 234, 236, 238, 240, 242, 244, 246, 248, 250, 252, 254, and 256 which are rotatably mounted in cassette 174. Idlers 220, 222, 224, 226, 228, 230, 232, 234, 236, 238, 240, 242, 244, 246, 248, 250, 252, 254, and 256 may be made from a variety of different materials such as plastic or elastomer. Tensioning devices 258, 260, and 262 are attached to cartridge 174 and are used on idlers 224, 242, and 254 to provide a biasing force shown by arrows 264, 266, and 268 that keeps sections 210, 212, 214, 216, and 218 of strip 178 taught. Tensioning devices 258, 260, and 262 may be constructed from wire, springs, or other biasing materials.

As noted above, the embodiment of optical encoder system 172 shown in FIG. 7 does not use a ratchet assembly. Instead, a drive wheel 270 is used which is rotatably mounted in take-up mechanism 208. Drive wheel 270 may be actuated by a motor of printing device 20 or manually, as more fully described below. As can be seen in FIG. 7, rotation of drive wheel 270 in a counter-clockwise direction shown by arrow 272, advances the portion of optical encoder strip 178 in use by optical encoder reader 85 toward cleaner 188 in the direction shown by arrow 274. As can also be seen in FIG. 7, as strip 178 passes over any of sets of idlers 230 and 232; 234, 236 and 238; 240, 242 and 244; and 246, 248 and 250 its direction is reversed. As noted above, his helps reduce the overall length of cassette 174.

Figure 8:
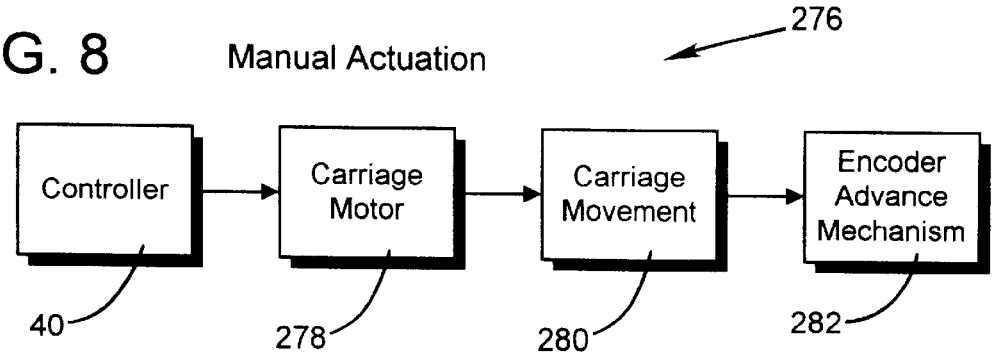
FIG. 8 is a block diagram of an embodiment of a method in accordance with the present invention of actuating an optical encoder system.

A block diagram of an embodiment of a method 276 in accordance with the present invention of actuating an optical encoder system is shown in FIG. 8. As can be seen in FIG. 8, method 276 utilizes controller 40 which operates the carriage motor, as represented by block 278, to move both carriage 45, as represented by block 280, and advance the optical encoder strip of the optical encoder system, as represented by encoder advance mechanism block 282. Method 276 is illustrated in operation in connection with optical encoder system 80 of FIGS. 2–5 and optical encoder system 172 of FIG. 6.

Figure 9:
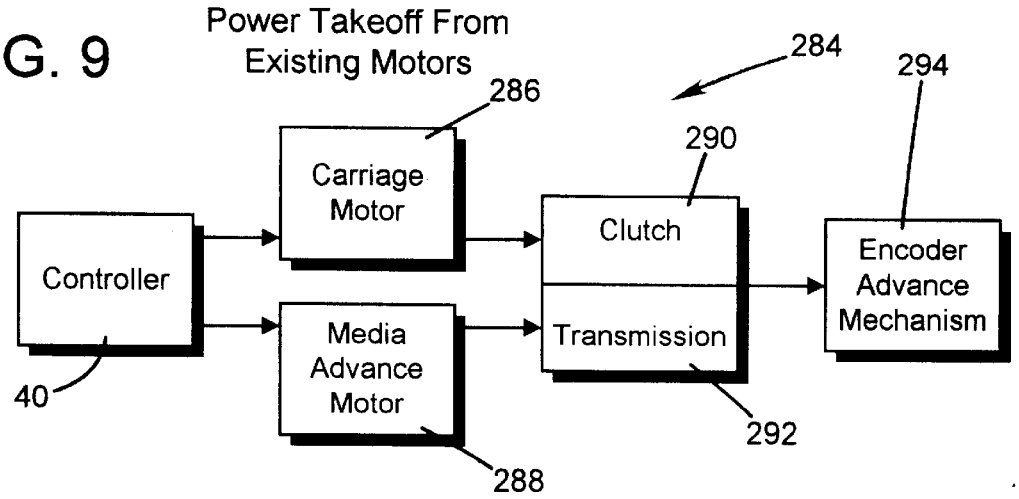
FIG. 9 is a block diagram of an alternative embodiment of a method in accordance with the present invention of actuating an optical encoder system.

A block diagram of an alternative embodiment of a method 284 in accordance with the present invention of actuating an optical encoder system is shown in FIG. 9. As can be seen in FIG. 9, method 284 utilizes controller 40 which operates both the carriage motor and media advance motor, as represented by respective blocks 286 and 288, to operate a clutch and transmission system, as represent by respective blocks 290 and 292. In the embodiment of method 284 shown, carriage motor 286 is shown operating clutch 290 and media advance motor 288 is shown operating transmission 292. This clutch and transmission system allows media advance motor 288 to control both advancement of print media when clutch 290 is disengaged from transmission 292, and actuation of encoder advance mechanism 294 to advance optical encoder strip via transmission 292 when clutch 290 is engaged. It is to be understood, however, that in other embodiments of method 284 of the present invention, alternative configurations are possible. For example, in an alternative embodiment of method 284, carriage motor 286 operates transmission 292 to actuate encoder advance mechanism 294 and media advance motor 288 operates clutch 290.

Figure 10:
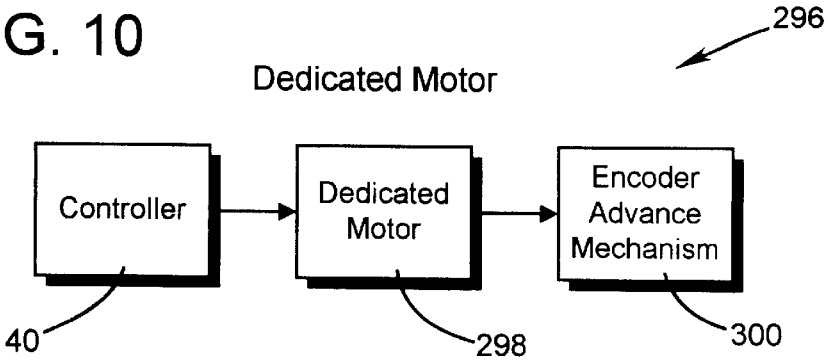
FIG. 10 is a block diagram of a further embodiment of a method in accordance with the present invention of actuating an optical encoder system.

A block diagram of a further embodiment of a method 296 in accordance with the present invention of actuating an optical encoder system is shown in FIG. 10. As can be seen in FIG. 10, method 296 utilizes controller 40 to operate a dedicated motor, as represented by block 298, to advance the optical encoder strip of the optical encoder system, as represented by encoder advance mechanism block 300. Method 296 is illustrated in operation in connection with optical encoder system 172 of FIG. 7.

Although the invention has been described and illustrated in detail, it is to be clearly understood that the same is intended by way of illustration and example only, and is not to be taken necessarily, unless otherwise stated, as an express limitation. For example, the peripheries of the pads of cleaners 106 and 188 may be differently shaped (e.g., flat). As another example, cleaners 106 and 188 may include more than one pair of pads and/or wipers/scrapers. As a further example, in one or more alternative embodiments of the present invention, the cleaner is not used. The spirit and scope of the present invention are to be limited only by the terms of the following claims.

What is claimed is:

1. An optical encoder system for use in a printing device, the optical encoder system comprising:

a dispenser, the dispenser including an encoder strip, the encoder strip having a first length and a second length, the second length of the encoder strip being substantially devoid of contaminant matter; and a take-up mechanism, the first length of the encoder strip being coupled to the take-up mechanism so that the first length of the encoder strip is positioned between the dispenser and the take-up mechanism, the take-up mechanism advancing at least a portion of the second length of the encoder strip from the dispenser to a position between the dispenser and the take-up mechanism upon actuation of the take-up mechanism.

2. The optical encoder system of claim 1, further comprising a cleaner for removing contaminant matter on the encoder strip during advancement of the encoder strip.

3. The optical encoder system of claim 2, wherein the cleaner includes one of a wiper and a scraper in contact with the encoder strip during removal of the contaminant matter therefrom.

4. The optical encoder system of claim 3, wherein the cleaner includes a liquid applied to the encoder strip.

5. The optical encoder system of claim 1, wherein the encoder strip is a loop which is positioned around the dispenser and the take-up mechanism.

6. The optical encoder system of claim 5, further comprising a container in which a portion of the encoder strip is placed, the container keeping the encoder strip therein substantially devoid of contaminant matter.

7. The optical encoder system claim 6, wherein the container take-up mechanism, and dispenser are one of a cassette and a cartridge.

8. The optical encoder system of claim 1, further comprising a tensioning device keeping the encoder strip substantially taut between the dispenser and the take-up mechanism.

9. The optical encoder system of claim 1 in a printing device.

10. An optical encoder system for use in a printing device, the optical encoder system comprising:

an encoder strip having a length; and means for selectively supplying a predetermined portion of the length of the encoder strip to the printing device for use by the printing device during printing, the predetermined portion of the length of the encoder strip being substantially devoid of contaminant matter upon initial supply to the printing device.

11. The optical encoder system of claim 10, further comprising means for cleaning contaminant matter from the encoder strip.

12. The optical encoder system of claim 10 in a printing device.

13. The optical encoder system of claim 10, further comprising means for tensioning the encoder strip.

14. A method for use in a printing device, the method comprising:

providing a first length of encoder strip to the printing device for use by the printing device during printing, the first length of encoder strip being substantially devoid of contaminant matter upon initial provision to the printing device;

removing the first length of encoder strip from use by the printing device; and advancing at least a portion of a second length of encoder strip to the printing device for use by the printing device during printing, the portion of the second length of the encoder strip being substantially devoid of contaminant matter upon initial advancement to the printing device.

15. The method of claim 14, further comprising cleaning the first length of the encoder strip to remove contaminant matter therefrom.

16. The method of claim 15, further comprising:

removing the portion of the second length of encoder strip from use by the printing device; and subsequent to cleaning, advancing the first length of encoder strip to the printing device for use by the printing device during printing.

* * * * *